US005945780A

United States Patent [19]

Ingle et al.

[11] Patent Number: 5,945,780

[45] Date of Patent: Aug. 31, 1999

[54] NODE PLATE FOR FIELD EMISSION DISPLAY

[75] Inventors: Arthur J. Ingle, Chandler; Charles Rowell, Tempe; Babu Chalamala, Chandler; Ronald O. Petersen, Phoenix; Craig Amrine, Tempe; Matthew Stainer, Phoenix, all of Ariz.

[73] Assignee: Motorola, Inc., Schaumburg, Ill.

[21] Appl. No.: 08/885,392

[22] Filed: Jun. 30, 1997

[51] Int. Cl.[6] ..... H01J 1/62

[52] U.S. Cl. ..... 313/495; 313/461; 313/473; 313/309

[58] Field of Search ..... 313/461, 463, 313/466, 467, 473, 309, 336, 351, 495

[56] References Cited

U.S. PATENT DOCUMENTS 4,185,227 1/1980 Morris .
5,453,659 9/1995 Wallace et al. .
5,477,105 12/1995 Curtin et al. .
5,498,925 3/1996 Bell et al. .
5,520,563 5/1996 Wallace et al. .
5,693,438 12/1997 Liu et al. .

*Primary Examiner*—Vip Patel
*Attorney, Agent, or Firm*—S. Kevin Pickens; Jasper Dockrey

[57] ABSTRACT

A field emission display (200) includes a cathode plate (202); a substrate (102) opposing the cathode plate (202); a conductive matrix (104) disposed on the substrate (102) and having via walls (103) defining a plurality of phosphor vias (105); a phosphor (106, 108, 110) disposed within each of the phosphor vias (105); and a gas-adsorption material distributed within the conductive matrix (104). A method for fabricating the field emission display (200) includes the steps of silk-screening onto the substrate (102) a screenable suspension, which is made from a glass, a metal, a gas-adsorption material, and a photo-sensitive material, to form a film; photo-patterning the film to form a phosphor via (105); depositing a phosphor material into the phosphor via (105) to form an anode plate (100); and affixing the cathode plate (202) to the anode plate (100).

35 Claims, 4 Drawing Sheets

NODE PLATE FOR FIELD EMISSION DISPLAY

FIELD OF THE INVENTION

The present invention pertains to the area of field emission displays and, more particularly, to an anode plate for a field emission display.

BACKGROUND OF THE INVENTION

Phosphors for field emission displays are known in the art. They are typically deposited onto a thin film of indium tin oxide (ITO) formed on a glass substrate. They are also typically covered by a film of aluminum, which is included to reflect light, dissipate electrical charge, and to provide mechanical stability to the phosphor material. This configuration suffers from the disadvantage that the phosphor extends into the strong electric field of the field emission display. Phosphor particles tend to become electrically charged, thereby increasing local electrostatic forces. These forces can cause phosphor particles to be ejected. A further disadvantage of this configuration is the loss of energy by electrons upon traversing the aluminum film. This reduces the power efficiency of the display, requiring higher anode voltages for a given brightness requirement.

Getters for field emission displays are also known in the art. Getters are used to remove contaminant gases within the field emission display, so that a suitable vacuum level is maintained therein. Prior art schemes for removing contaminant gases suffer from poor configurations with respect to the sources of the contaminant gases.

In one prior art scheme, the gettering material is disposed in a plenum region, behind the emitter plate. Access to the getter is provided by holes in the emitter plate. This prior art scheme suffers from a poor configuration of the getter with respect to the phosphor material, which is a significant source of gaseous contaminants. The contaminants must traverse the space between the anode plate and the cathode plate and thereafter travel through the holes in the cathode plate to reach the gettering material. This long path to the gettering material increases the probability that contaminants will contaminate structures, such as the emitter structures, within the display.

Accordingly, there exists a need for an improved anode structure that protects the phosphor material and improves the efficiency of the display. There further exists a need for an improved gettering configuration for a field emission display, which provides for the removal of contaminant gases proximate to the their sources.

Figure 1:
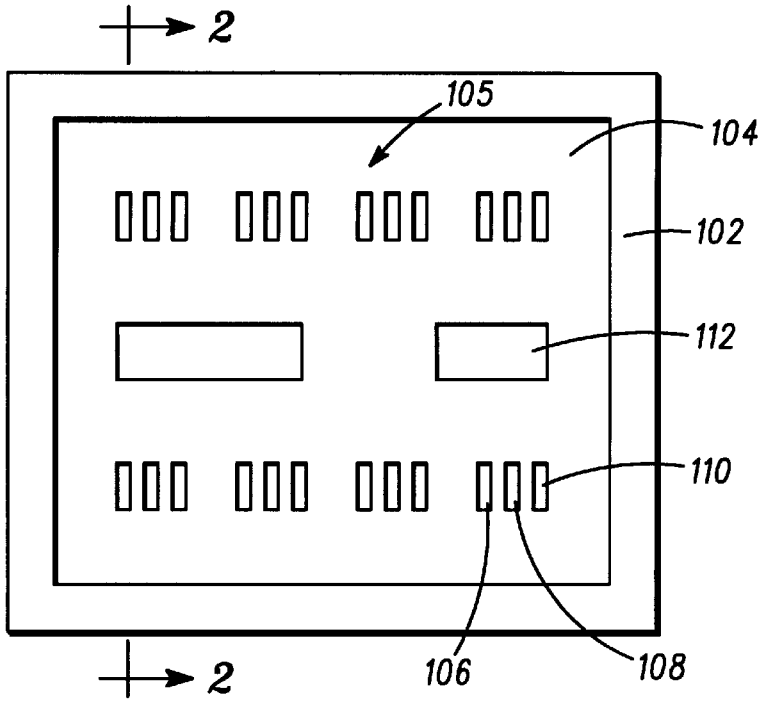
FIG. 1 is a bottom plan view of a first embodiment of an anode plate for a field emission display in accordance with the invention.

It will be appreciated that for simplicity and clarity of illustration, elements shown in the FIGURES have not necessarily been drawn to scale. For example, the dimensions of some of the elements are exaggerated relative to each other. Further, where considered appropriate, reference numerals have been repeated among the FIGURES to indicate corresponding elements.

DESCRIPTION OF THE PREFERRED EMBODIMENTS

The invention is for a field emission display having an anode structure that includes a conductive matrix, which contains the cathodoluminescent phosphors. The phosphors are disposed within phosphor vias defined by the conductive matrix. In the configuration of the invention, the conductive matrix shields the phosphors from the electric field. The conductive matrix also provides a conduction path to prevent the accumulation of electrical charge at the phosphors, which would otherwise tend to repel approaching electrons. The walls defining the phosphor vias can be made reflective, thereby increasing the brightness of the display. The conductive matrix can also define the anode electrode of the field emission display, thereby obviating the need for a separate anode electrode, such as the ITO layer typically employed in the prior art. In the preferred embodiment of the invention, the conductive matrix further includes a distributed gas-adsorption material. This gas-adsorption material is provided in close proximity to the phosphor material, which is a significant source of gaseous contaminants within a field emission display.

FIG. 1 is a bottom plan view of an anode plate 100 for a field emission display in accordance with the invention. Anode plate 100 includes a substrate 102, which is made from a hard, transparent material, such as glass, quartz, and the like. Substrate 102 has a critical temperature that is equal to 50° C. above the annealing temperature of substrate 102.

A conductive matrix 104 is affixed to substrate 102. Conductive matrix 104 includes a thick film that is conductive. Conductive matrix 104 further defines a plurality of phosphor vias 105, which contain the cathodoluminescent phosphors. The embodiment of FIG. 1 includes a polychromatic display. So, the phosphor material includes a red phosphor 106, a green phosphor 108, and a blue phosphor 110, which define a plurality of pixels. By way of example, and no way intended to be limiting, the dimensions of phosphor vias 105 are about 50×180 micrometers.

However, the present invention is not limited to polychromatic displays and can be embodied by a monochromatic field emission display. The particular phosphor configuration depicted in FIG. 1 is exemplary and in no way intended to be limiting. Also indicated in FIG. 1 are a plurality of spacer regions 112 of the surface of conductive matrix 104.

Figure 2:
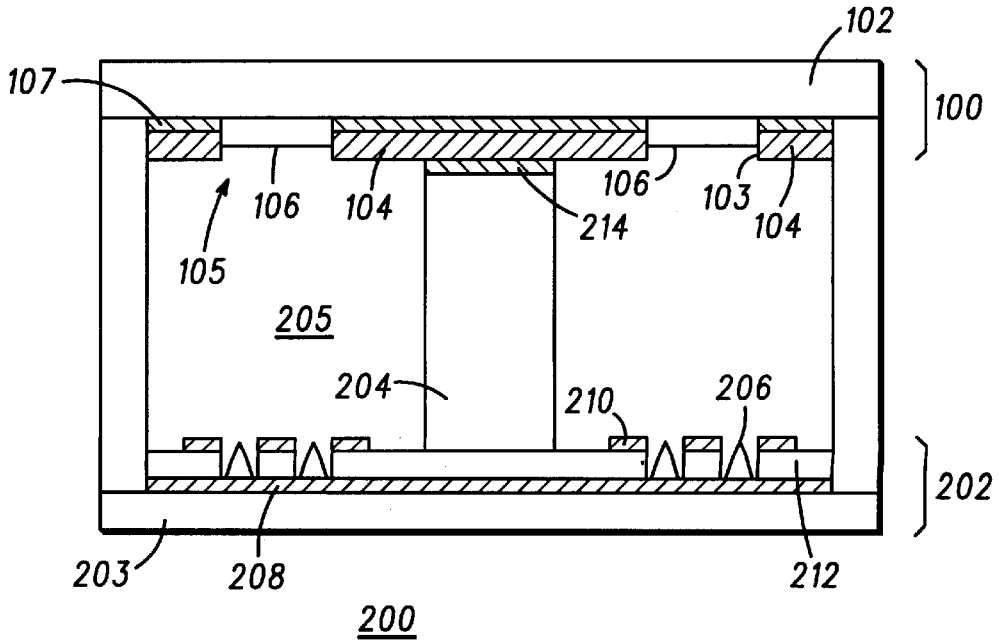
FIG. 2 is a cross-sectional view taken along the section line 2—2 of FIG. 1 of a field emission display in accordance with the invention.

FIG. 2 is a cross-sectional view taken along the section line 2—2 of FIG. 1 of a field emission display 200 in accordance with the invention. Field emission display 200 includes anode plate 100 and further includes a cathode plate 202, which opposes anode plate 100. Cathode plate 202 is spaced apart from anode plate 100 by a spacer 204 to define an interspace region 205 therebetween. In the embodiment of FIG. 2, and in no way intended to be limiting, spacer 204 includes a rib made from a dielectric material, such as glass, ceramic, and the like. One of the opposing edges of spacer 204 contacts one of spacer regions 112 of conductive matrix 104, and the other opposing edge of spacer 204 contacts cathode plate 202. Cathode plate 202 includes a substrate 203, upon which are formed a cathode electrode 208 and a plurality of electron emitters 206. Electron emitters 206 oppose phosphor vias 105.

Conductive matrix 104 has a plurality of via walls 103, which define phosphor vias 105. The phosphor material is disposed within phosphor vias 105. In the preferred embodiment, the depth of each of phosphor vias 105 is greater than the depth of phosphor 106, 108, or 110 disposed therein. This configuration provides an exposed portion of via walls 103. The exposed portion of via walls 103 of conductive matrix 104 provides many advantages. For example, for a given phosphor thickness, a greater via depth provides greater shielding of the phosphor material from the electric field. This is due to the conductive characteristic of conductive matrix 104. The depth of phosphor vias 105 is equal to the thickness of conductive matrix 104, which is about 10–12 micrometers. An exemplary thickness of each of phosphors 106, 108, 110 is within a range of about 3–10 micrometers.

Via walls 103 are also useful for reflecting-light incident thereon. Some of the light emitted by phosphors 106, 108, 110 is incident on via walls 103. Of this incident light, a fraction forms an angle of incidence such that it is reflected in a direction away from interspace region 205. This improves the brightness efficiency and color purity of the display. Via walls 103 are also useful for collecting secondary electrons incident thereon, which are emitted from phosphors 106, 108, 110.

In the preferred embodiment of FIG. 2, no aluminum overlayer is formed on the phosphor material. The omission in the present invention of the prior art aluminum overlayer precludes the attenuation of the energy of the incident electrons, which would otherwise occur upon their traversal of the prior art aluminum overlayer. This retention of electron energy also improves the efficiency of field emission display 200.

In the preferred embodiment of FIG. 2, no prior ITO film is formed on substrate 102. Phosphors 106, 108, 110 are disposed within phosphor vias 105 and are affixed to the surface of substrate 102.

In the preferred embodiment of FIG. 2, conductive matrix 104 further includes a contrast layer 107. Contrast layer 107 is disposed on the surface of substrate 102 and is light-absorbing, so that it enhances the contrast of the display image. In the embodiment of FIG. 2, contrast layer 107 is made from the glass/metal mixture comprising conductive matrix 104 and further includes a contrast enhancement material, which imparts a dark, light-absorbing color to the film. This contrast enhancement constituent preferably includes ruthenium oxide, which imparts a black color to contrast layer 107.

In the preferred embodiment of FIG. 2, the remainder of conductive matrix 104 does not include the ruthenium oxide. However, in another embodiment of the invention, a contrast enhancement constituent is distributed throughout conductive matrix 104. In yet a further embodiment, contrast layer 107 includes a black chrome material.

Conductive matrix 104 further includes a gas-adsorption material, which is distributed therein. The gas-adsorption material includes a material, such as a non-evaporable getter, a molecular sieve sorbent, and the like, and combinations thereof, which is useful for removing undesirable gaseous species from interspace region 205. These undesirable gaseous species include water, oxygen, carbon dioxide, carbon monoxide, nitrogen, and desorbed gaseous species, such as those liberated from phosphors 106, 108, 110 during electron bombardment. Conductive matrix 104 has a porosity that provides access by the undesirable gaseous species to the gas-adsorption material contained therein. Conductive matrix 104 has a composition of the gas-adsorption material that is within a range of 10–80 per cent by volume. The particle size of the gas-adsorption material is less than the characteristic dimensions of phosphor vias 105, preferably within a range of 10 nanometers to 10 micrometers, so that a misplaced gas-adsorption particle cannot substantially block one of phosphor vias 105.

An exemplary non-evaporable getter is made from a mixture of 70% by weight zirconium, 24.6% by weight vanadium, and 5.4% by weight iron. Exemplary molecular sieve sorbents include zeolites, aerosols, and the like. An exemplary zeolite is an alumino-silicate having pore sizes within a range of 3–20 angstroms and having a particle size within a range of 50 nanometers to 10 micrometers.

In the preferred embodiment of FIG. 2, conductive matrix 104 is made from a mixture of a glass and a metal, such as silver, copper, gold, palladium, platinum, combinations thereof, and the like. The metal composition of this mixture is within a range of about 5–100 per cent by volume. The metallic constituent imparts conductivity to conductive matrix 104 and reflectivity to via walls 103. In general, the composition of the metal is predetermined to impart to conductive matrix 104 a resistivity that is less than 100 $\Omega/cm^2$, preferably less than 10 $\Omega/cm^2$. Methods are contemplated for enhancing the reflectivity of via walls 103, such as described in detail with reference to FIG. 7. The glass constituent of conductive matrix 104 includes a glass having a bonding (eg., melting, sintering) temperature that is less than the critical temperature of substrate 102.

In a preferred method for fabricating a field emission display in accordance with the invention, the conductive matrix is formed by first forming on the anode substrate a film containing the glass/metal mixture. The film is further patterned to realize the phosphor vias. The patterning may be realized during the deposition step, such as by screen printing using a screen that defines the pattern of the phosphor vias. Alternatively, the patterning may be realized subsequent to the deposition step, such as by photo-patterning of a film that is deposited by silk-screening. When photo-patterning is employed, the film further includes a photo-sensitive material in an amount sufficient to make the film photo-patternable.

A preferred method for forming field emission display 200 will now be described. Conductive matrix 104 is made using a conductive photo-printable material, which is available from E.I. du Pont de Nemours and Company of Wilmington, Del., and sold under the trademark FODEL. The FODEL is a mixture including a glass, silver metal, and a photo-sensitive polymer. The glass constituent has a bonding (eg., melting, sintering) temperature less than about 600° C. The silver composition of the FODEL is about 80 per cent by volume. The concentration of the photo-sensitive polymer is sufficient to impart photo-sensitivity to the dried FODEL film, so that it may be photo-patterned.

Conductive matrix 104 is made by first forming contrast layer 107 on substrate 102. To form contrast layer 107, a contrast enhancement material (glass-tinting material), such as ruthenium oxide, nickel oxide, and the like, is admixed to the FODEL paste in an amount sufficient to form a black paste. The black paste is then silk screened onto the dry surface of substrate 102 to form a black film. The black film has a thickness within a range of about 3–5 micrometers. Substrate 102 is then placed in a low temperature oven, and the black film is dried by heating at about 80° C. for about 20 minutes.

Thereafter, a white paste is formed by admixing the FODEL paste with the gas-adsorption material. The white paste is silk screened onto the black film to form a white film. Substrate 102 is then placed in a low temperature oven to dry the white film at a temperature of about 80° C. for about 20 minutes.

The dried films are then exposed to collimated ultra-violet light through a mask. The regions of the films that are to be removed are not exposed to the UV light. Thereafter, the films are developed using a sodium bicarbonate solution having a pH of 11. The developing step causes the unexposed regions to be removed, thereby forming phosphor vias 105. The resulting structure is then baked in an appropriate atmosphere to decompose the photo-sensitive polymer and bond the glass constituent, thereby forming a cohesive structure that is affixed to substrate 102. The nature of the baking atmosphere depends, in part, upon the type of gas-adsorption material employed. For example, if a non-evaporable getter is included, the baking atmosphere is an inert one, such as argon, vacuum, and the like, and the baking temperature is less than about 300° C. Alternatively, if a molecular sieve sorbent is employed, the baking can be performed at about 560° C. in air. During this heating step, the molecular sieve sorbent, if included in the film, desorbs any water, carbon dioxide, oxygen, and other sorbed gases contained therein.

Subsequent to the affixation of conductive matrix 104 to substrate 102, phosphors 106, 108, 110 are deposited into phosphor vias 105 by one of several phosphor deposition methods, which are known to one skilled in the art. An exemplary screen printing process for the deposition of phosphors 106, 108, 110 includes using a patterned screen to deposit the phosphor material directly into phosphor vias 105. If a fine pixel pitch is desired, a photo-sensitive polymer binder can be added to the phosphor materials. Then, the different color phosphor materials are sequentially silk screened, photo-imaged, and developed. Thereafter, substrate 102 is heated at about 450° C. for about one hour to burn off the photo-sensitive binder. A useful photo-sensitive polymer binder is a mixture of polyvinyl alcohol and ammonium dichromate. Another useful photo-sensitive polymer binder is polymethylene-p-diazodiphenylamine, which is obtainable from Fairmont Chemical Company of Newark, N.J.

Phosphors 106, 108, 110 are affixed within phosphor vias 105 by one of several methods, such as by van der Waals forces, the addition of a cement, the addition of a glue, and the like. For example, a "glue" material can be incorporated into the phosphor paste prior to its deposition into phosphor vias 105. By way of example, the glue material may include TEOS.

In another method for affixing the phosphors within the phosphor vias, the constituent particles of the phosphor material are encapsulated in a thin conductive coating, which can be bonded (eg., melted, sintered) upon heating to form a cohesive phosphor matrix that is affixed to the anode substrate. Such a coated phosphor is described in a U.S. Pat. No. 5,667,724, by R. Petersen, which was issued on Sep. 16, 1997 to the same assignee, and which is incorporated herein by reference. After depositing the coated phosphor material into the phosphor vias, the coated phosphor material is heated to a temperature sufficient to consolidate the thin conductive coatings and is thereafter cooled, thereby forming a cohesive phosphor layer that is affixed to the anode substrate and to the conductive matrix. The resulting conductive phosphor matrix also enhances intra-phosphor electrical conductivity.

Subsequent to the formation of phosphors 106, 108, 110, spacer 204 is affixed to anode plate 100. The affixed edge of spacer 204 has a bonding layer 214, which includes a layer of a metal, such as gold, aluminum, and the like. Bonding layer 214 is affixed to conductive matrix 104 by a convenient method, such as thermal compression bonding, ultrasonic bonding, and the like. Conductive matrix 104 provides the further advantage of enhanced bonding capabilities to bonding layer 214 of spacer 204.

In the preferred embodiment of FIG. 2, the electrodes of field emission display 200 include cathode electrode 208, a gate extraction electrode 210, and conductive matrix 104. Gate extraction electrode 210 is spaced apart from cathode electrode 208 by a dielectric layer 212. Each electrode is designed to receive a potential from a potential source (not shown). During the operation of field emission display 200, potentials are applied to effect electron emission from selected ones of electron emitters 206, in a manner known to one skilled in the art. The emitted electrons traverse interspace region 205, to be received by the opposing phosphors 106, 108, 110. The accumulated charge is conducted away from phosphors 106, 108, 110 by conductive matrix 104. This operation of the invention obviates the need for an ITO sublayer, such as is employed in the prior art for the purposes of providing the anode potential and conducting charge away from the phosphors.

In the embodiment of FIG. 2, the invention is embodied by a triode display. It is desired to be understood that the present invention can also be embodied by a diode display and by displays having greater than three electrodes, including, for example, focusing electrodes.

In another embodiment of the invention, the conductive matrix is made from a mixture of a gas-adsorption material and an alloy. The alloy has a bonding (eg., melting, sintering) temperature that is lower than the critical temperature of the anode substrate and higher than the sealing temperature of the display. This provides a bonding temperature of the gas-adsorption material/alloy mixture that is less than the critical temperature of the anode substrate and greater than the sealing temperature of the display. The alloy composition of this mixture is within a range of about 10–75 per cent by volume. In general, the alloy composition is sufficient to provide a cohesive layer, which contains the gas-adsorption material, upon bonding (eg., melting, sintering) of the alloy.

An exemplary alloy for use in this mixture contains 82% by weight gold and 18% by weight indium. This alloy has a liquidus at 485° C. and a solidus at 451° C. Another option is an alloy that contains 45% by weight silver, 38% by weight gold, and 17% by weight germanium and has a eutectic point at 525° C.

A representative non-evaporable getter for use in the gas-adsorption material/alloy mixture includes 70% by weight zirconium, 24.6% by weight vanadium, and 5.4% by weight iron. Non-evaporable getters typically have high sintering temperatures, on the order of about 875° C., which are greater than the typical strain temperature of substrate 102, which is on the order of about 600° C.

The gas-adsorption material/alloy mixture is applied as a film to the surface of the anode substrate by using a convenient deposition method, such as deposition through a screen, doctor blade, electrophoretic deposition, and the like. The film is patterned to define the phosphor vias by a convenient patterning method, such as screen printing using a screen that defines the pattern of the phosphor vias, photo-patterning subsequent to a silk-screening deposition, and the like.

If the gas-adsorption material/alloy mixture is applied by deposition through a screen, the gas-adsorption material and the alloy are dispersed in a solvent carrier, such as propylene carbonate. A binder is also added to the solvent. Useful binders include polyalkylene carbonate binders, such as polyethylene carbonate, polypropylene carbonate, and the like. Photo-sensitive variants of these binders are useful if a photo-patterning method is employed for patterning the gas-adsorption material/alloy film.

If a photo-patterning method is employed for patterning the gas-adsorption material/alloy film, the screenable suspension is silk screened onto the surface of the anode substrate and then dried at about 100° C. Thereafter, the film is photo-imaged, developed, and dried. The patterned film is then heated in an inert atmosphere, such as Argon, or in a vacuum, at a temperature of about 300° C. to remove the organic binder.

The temperature is also raised to the bonding temperature of the alloy to bond the alloy. Then, the film is cooled, thereby realizing a cohesive conductive matrix that is affixed to the substrate. The phosphor materials are deposited into the phosphor vias, as described previously. Then, the anode plate, spacers, and cathode plate are assembled to provide the field emission display.

Figure 3:
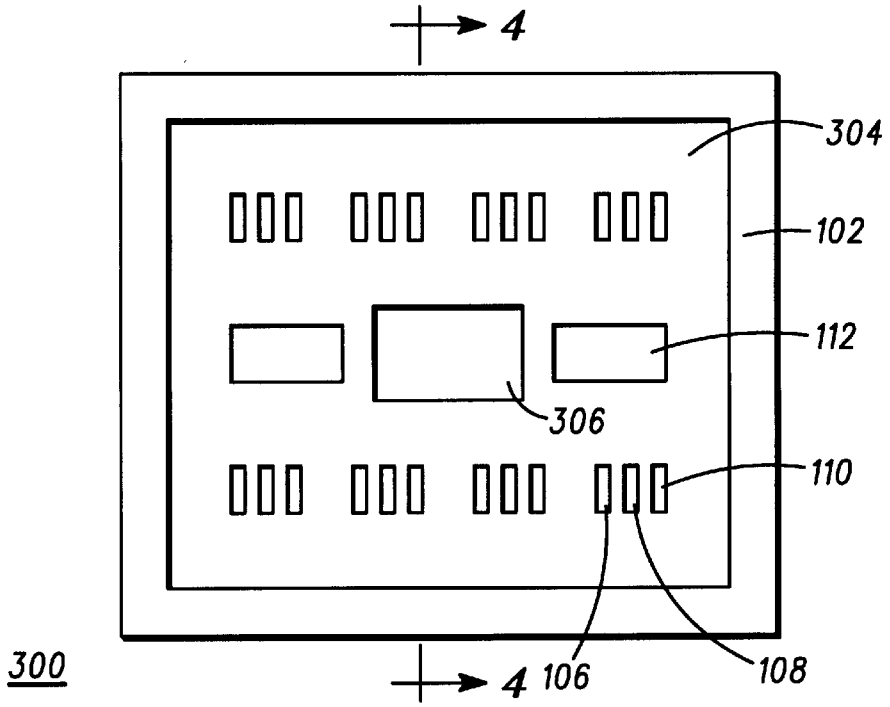
FIG. 3 is a bottom plan view of a second embodiment of an anode plate for a field emission display in accordance with the invention.

FIG. 3 is a bottom plan view of an anode plate 300 for a field emission display in accordance with the invention. Anode plate 300 includes a conductive matrix 304, which is formed on substrate 102 in a manner similar to that described with reference to conductive matrix 104 of FIGS. 1 and 2. Conductive matrix 304 includes a plurality of via walls 303, which define a plurality of phosphor vias 305. However, in the embodiment of FIG. 3, no gas-adsorption material is added to the FODEL paste. Thus, no gas-adsorption material is distributed within conductive matrix 304. Rather, a gas-adsorption layer 306 is affixed to a surface defined by conductive matrix 304. Gas-adsorption layer 306 includes a gas-adsorption material, such as a non-evaporable getter, a molecular sieve sorbent, a combination thereof, and the like.

Further, in the embodiment of FIG. 3, conductive matrix 304 does not include a distinct contrast sub-layer. Rather, a contrast enhancement material, such as ruthenium oxide, nickel oxide, and the like, is distributed throughout conductive matrix 304. However, in a further embodiment of the invention, a distinct gas-adsorption layer and a distinct contrast layer are both employed.

Figure 4:
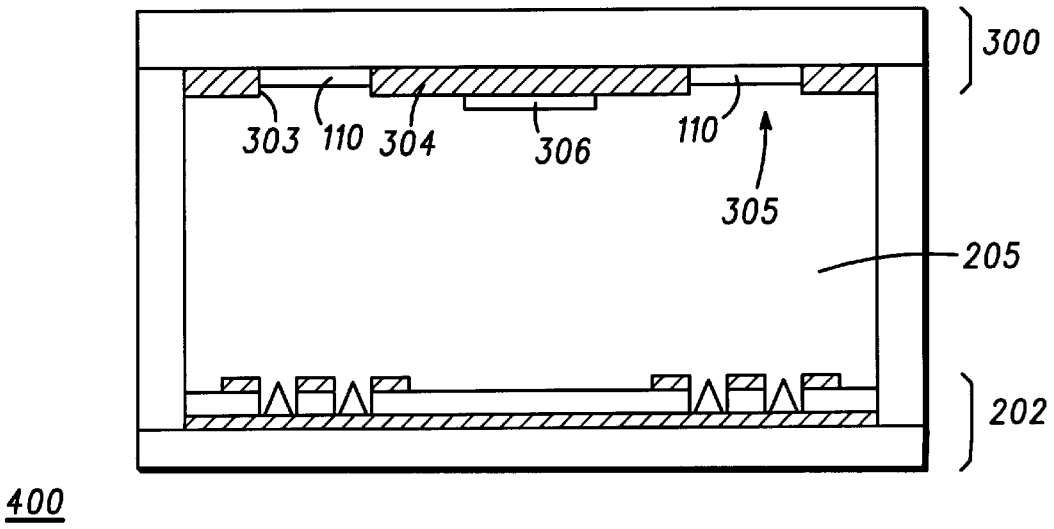
FIG. 4 is a cross-sectional view taken along the section line 4—4 of FIG. 3 of a field emission display in accordance with the invention.

FIG. 4 is a cross-sectional view taken along the section line 4—4 of FIG. 3 of a field emission display 400 in accordance with the invention. Gas-adsorption layer 306 is formed subsequent to the formation of conductive matrix 304. The method for forming gas-adsorption layer 306 can include the gas-adsorption material/alloy deposition method described with reference to FIG. 2.

In an exemplary method for forming gas-adsorption layer 306, a screenable suspension is made by dispersing a gas-adsorption material/alloy mixture, such as described with reference to FIG. 2, in a solvent carrier, such as propylene carbonate, acetone, cellosolve acetate, and the like. The solvent carrier also has dispersed in it a polyalkylene carbonate binder, such as polyethylene carbonate, polypropylene carbonate, and the like. The screenable suspension is deposited through a screen onto conductive matrix 304 to form a film. The screen may define the pattern for gas-adsorption layer 306. Alternatively, a blanket film may be deposited by silk-screening and thereafter dried and photo-patterned, if the binder is photo-sensitive.

In an exemplary electrophoretic method for forming gas-adsorption layer 306, a gas-adsorption material/alloy mixture, such as described with reference to FIG. 2, is mixed in a solvent, such as isopropyl alcohol, to provide an electrophoretic suspension. No binder is required. A potential is applied to conductive matrix 304. Simultaneously, the electrophoretic suspension is contacted with the surface of conductive matrix 304 through a mask defining the pattern of gas-adsorption layer 306. Thereafter, substrate 102 is heated in an inert atmosphere, such as Argon, or in a vacuum, at a temperature of about 300° C. This heating step removes the solvent and bonds (eg., melts, sinters) the alloy. Then the structure is cooled, so that gas-adsorption layer 306 defines a cohesive layer that is affixed to conductive matrix 304.

Figure 5:
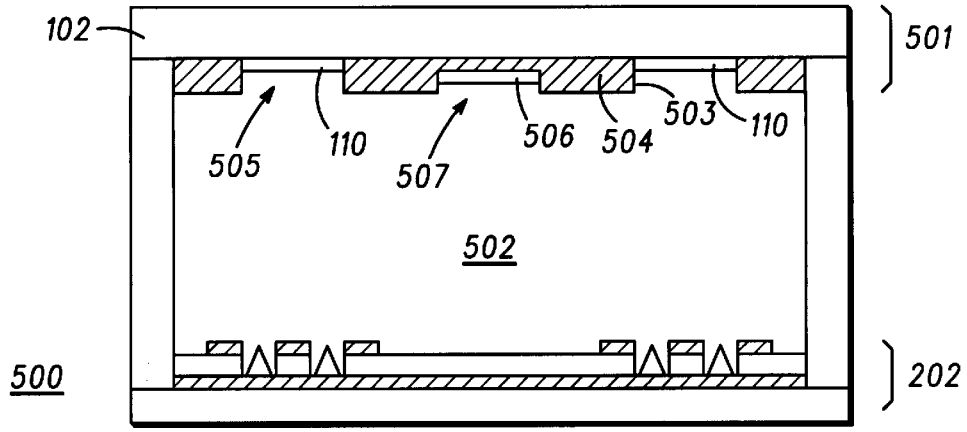
FIG. 5 is a cross-sectional view of a third embodiment of a field emission display in accordance with the invention.

FIG. 5 is a cross-sectional view, similar to that of FIG. 4, of a field emission display 500 in accordance with the invention. Field emission display 500 includes an anode plate 501, which has a conductive matrix 504. Conductive matrix 504 is made in a manner similar to that described with reference to FIG. 4. However, in the embodiment of FIG. 5, conductive matrix 504 further includes a plurality of gas-adsorption wells 507. Each of gas-adsorption wells 507 includes a recess defined by conductive matrix 504 and contains a gas-adsorption layer 506.

In an exemplary method for forming gas-adsorption wells 507, a first layer of the FODEL paste is deposited onto substrate 102 and dried. Thereafter, a second layer of the FODEL paste is screen-printed onto the first layer through a screen which blocks deposition of the paste at the predetermined locations of gas-adsorption wells 507. The second layer is then dried. The dried films are photo-patterned in the manner described with reference to FIG. 2, to form a plurality of phosphor vias 505.

Thereafter, gas-adsorption layer 506 is formed within gas-adsorption wells 507, in the manner described with reference to FIG. 4. In the embodiment of FIG. 5, gas-adsorption layer 506 is shielded by conductive matrix 504 from the electric field within an interspace region 502. Affixation of gas-adsorption layer 506 within a well structure also improves its mechanical stability. Conductive matrix 504 further includes a plurality of via walls 503, which define plurality of phosphor vias 505, for containing phosphors 106, 108, 110, in the manner described with reference to FIG. 2

Figure 6:
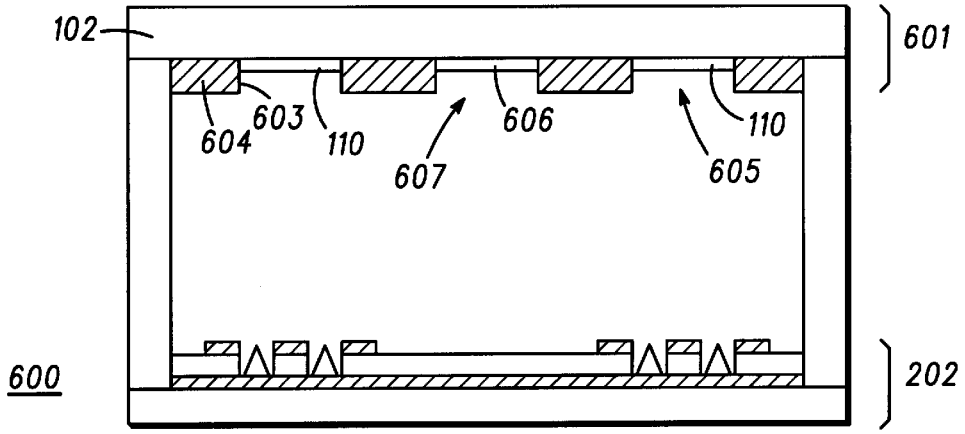
FIG. 6 is a cross-sectional view of a fourth embodiment of a field emission display in accordance with the invention.

FIG. 6 is a cross-sectional view, similar to that of FIGS. 4 and 5, of a field emission display 600 in accordance with the invention. Field emission display 600 includes an anode plate 601, which has a conductive matrix 604 formed on substrate 102. Conductive matrix 604 includes a plurality of via walls 603, which define a plurality of phosphor vias 605. Conductive matrix 604 is formed in a manner similar to that described with reference to FIG. 2 for the formation of a FODEL film, without including the gas-adsorption material therein. However, in the embodiment of FIG. 6, a plurality of gas-adsorption vias 607 are formed during the step for forming phosphor vias 605, as described with reference to FIG. 2. A gas-adsorption layer 606 is formed within each of gas-adsorption vias 607 and is affixed to substrate 102. Gas-adsorption layer 606 is formed by a convenient method, similar to the methods described with reference to FIGS. 3–5. Gas-adsorption layer 606 is formed prior to the deposition of the phosphor materials.

Figure 7:
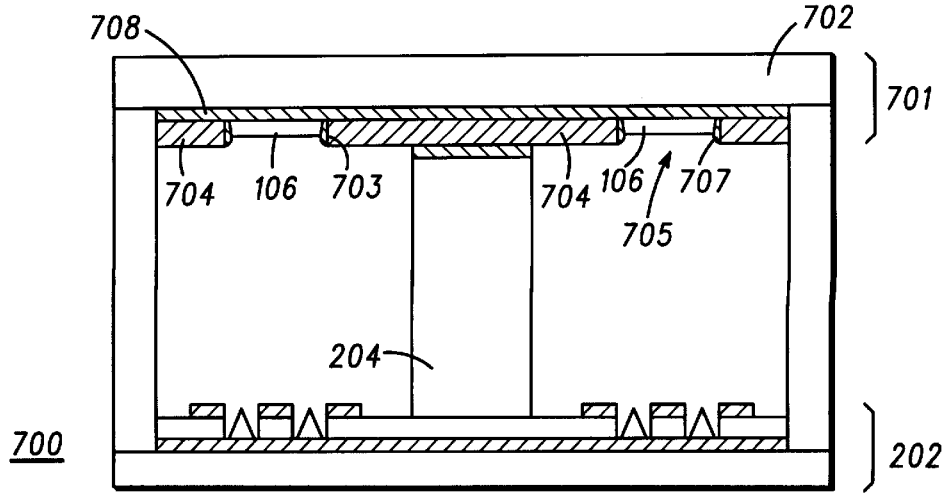
FIG. 7 is a cross-sectional view of a fifth embodiment of a field emission display in accordance with the invention.

FIG. 7 is a cross-sectional view, similar to that of FIG. 2, of a field emission display 700 in accordance with the invention. Field emission display 700 includes an anode plate 701, which has a conductive matrix 704 formed on a substrate 702. Substrate 702 includes a transparent plate, upon which is formed a conductive film 708. Conductive film 708 is made from a conductive, transparent material, such as ITO.

Conductive matrix 704 is formed in a manner similar to the methods described with reference to FIGS. 1–6. However, in the embodiment of FIG. 7, conductive matrix 704 further includes an optical enhancement film 707, which is provided on each of a plurality of via walls 703, which define a plurality of phosphor vias 705.

Optical enhancement film 707 is made from an optical enhancement material that enhances the brightness and/or color purity of field emission display 700. For example, optical enhancement film 707 can be made from a reflective material, such as gold, chrome, and the like. In this particular example, optical enhancement film 707 provides a surface that reflects a fraction of the light incident thereon, thereby enhancing the brightness and color purity of field emission display 700. In a further example, the optical enhancement film is made from a light-absorbing material, thereby improving the color purity of the display. The latter example is particularly useful for anode configurations in accordance with the invention, which do not include a contrast layer or a contrast enhancement material in the conductive matrix.

The brightness improvement realized by reflective optical enhancement film 707 is particularly advantageous in the configuration wherein a contrast enhancing constituent is distributed throughout conductive matrix 704. That is, a fraction of the light, which would otherwise be absorbed at via walls 703 due to the contrast enhancing constituent, is reflected by optical enhancement film 707 to add brightness to the display image. Optical enhancement film 707 can also be useful for enhancing the bonding of phosphors 106, 108, 110 within phosphor vias 705.

Optical enhancement film 707 is formed subsequent to the formation of phosphor vias 705 and prior to the deposition of phosphors 106, 108, 110. In an exemplary method for forming optical enhancement film 707, a blanket lift-off layer is deposited onto conductive matrix 704 by a convenient deposition method. An aluminum lift-off layer can be used. This deposition is a normal deposition, so that the lift-off material is deposited onto lateral surfaces and not onto via walls 703. Thereafter, a blanket layer of the optical enhancement material is deposited using an angled deposition, so that the optical enhancement material is deposited onto via walls 703. The lift-off layer is then removed, so that the optical enhancement material on via walls 703 remains. Thereafter, a gas-adsorption layer can be formed, if the gas-adsorption material is not already included in conductive matrix 704, in a manner described with reference to FIGS. 3–6.

Phosphors 106, 108, 110 are then deposited within phosphor vias 705. For the embodiment of FIG. 7, phosphors 106, 108, 110 can be deposited by electrophoretic deposition methods, which are known to one skilled in the art. Alternatively, the phosphor material can be deposited in the manner described with reference to FIG. 2.

Phosphors 106, 108, 110 may be affixed within phosphor vias 705 by incorporating an appropriate "glue" material into the phosphor paste prior to its deposition into phosphor vias 705. An exemplary glue material is tetraethyl orthosilicate (TEOS). Affixation of phosphors 106, 108, 110 can also be realized by adding to the phosphor paste a small amount (less than or equal to about 5% by weight) of phosphoric or boric acid. Upon heating to a temperature below 500° C., the acid is converted to an oxide that bonds the phosphor to conductive film 708.

Figure 8:
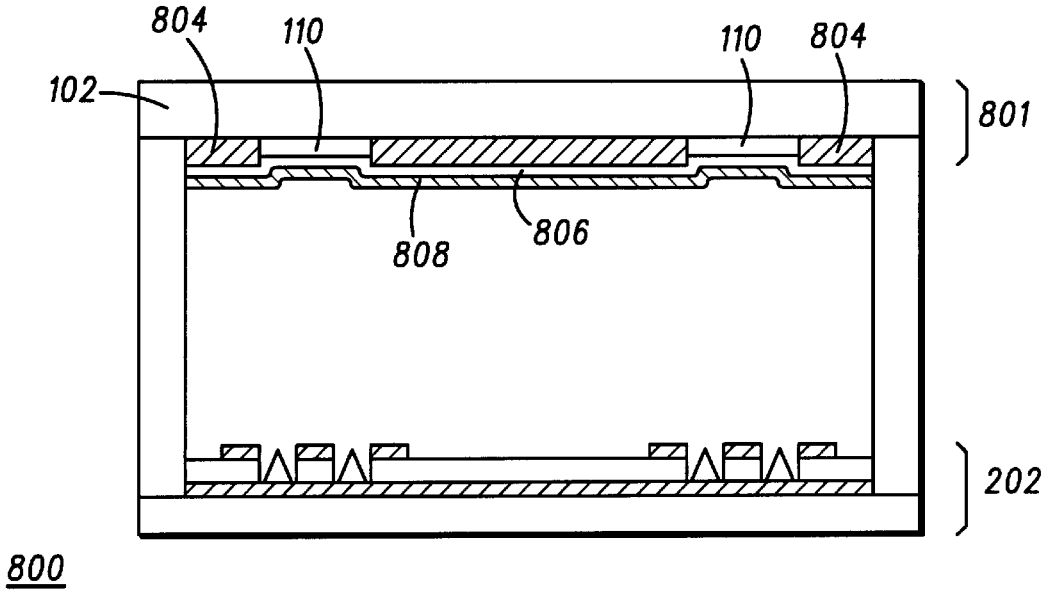
FIG. 8 is a cross-sectional view of a sixth embodiment of a field emission display in accordance with the invention.

FIG. 8 is a cross-sectional view, similar to that of FIG. 4, of a field emission display 800 configured in accordance with the invention. Field emission display 800 includes an anode plate 801 that has a conductive matrix 804 and phosphors 106, 108, 110, which are formed on substrate 102, in the manner described with reference to FIG. 4. The embodiment of FIG. 8 further includes a gas-adsorption layer 806, which is disposed on the surfaces of conductive matrix 804 and on the surfaces of phosphors 106, 108, 110. Gas-adsorption layer 806 includes a thin layer of a gas-adsorption material, such as a molecular sieve sorbent, a non-evaporable getter, and the like. The embodiment of FIG. 8 further includes a retention layer 808, which is affixed to gas-adsorption layer 806. Retention layer 808 maintains the proximate configuration of gas-adsorption layer 806 with respect to conductive matrix 804 and phosphors 106, 108, 110.

Gas-adsorption layer 806 is formed by lightly dusting a powdered form of the gas-adsorption material onto the exposed surfaces of conductive matrix 804 and phosphors 106, 108, 110. Preferably, gaps exist between adjacent particles of the gas-adsorption material within gas-adsorption layer 806. In general, these gaps are increased when employing gas-adsorption materials having larger particle sizes.

Subsequent to the formation of gas-adsorption layer 806, retention layer 808 is formed thereon. Retention layer 808 preferably includes a thin layer of aluminum, having a thickness within a range of about 300–1000 angstroms. A standard aluminization process may be employed, as is known to one skilled in the art. If the gas-adsorption material includes a non-evaporable getter, however, the laquer employed in the aluminization process is selected to be decomposable in an inert atmosphere. An exemplary laquer for this configuration is nitrocellulose. If the gas-adsorption material only includes molecular sieve sorbents, standard aluminizing methods can be employed, wherein the laquer decomposes by heating in air.

In summary, a field emission display according to the invention includes an anode plate that has a conductive matrix, which contains the phosphor. The conductive matrix further shields the phosphor from the electric field within the display. The anode plate of the invention obviates the need for the ITO sublayer and the aluminum overlayer of the prior art. Methods for forming the conductive matrix of the invention do not require the use of a photo-resist. The anode plate of the invention also provides a distributed gas-adsorption material proximate to the phosphors.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

We claim:

1. A field emission display comprising:

a cathode plate having a plurality of electron emitters;

a substrate having a major surface opposing the plurality of electron emitters of the cathode plate;

a conductive matrix disposed on the major surface of the substrate and having a plurality of via walls defining a plurality of phosphor vias; and a phosphor disposed within each of the plurality of phosphor vias.

2. The field emission display of claim 1, wherein the conductive matrix has a resistivity that is less than 100 $\Omega/cm^2$.

3. The field emission display of claim 2, wherein the resistivity of the conductive matrix is less than 10 $\Omega/cm^2$.

4. The field emission display of claim 1, wherein the conductive matrix comprises a mixture including a glass and a conductive material, the mixture having a composition of the conductive material within a range of 5–100 per cent by volume.

5. The field emission display of claim 4, wherein the conductive material includes a metal.

6. The field emission display of claim 5, wherein the metal includes silver.

7. The field emission display of claim 1, wherein the conductive matrix comprises a gas-adsorption material distributed therein, the conductive matrix having a composition of the gas-adsorption material within a range of 10–80 per cent by volume.

8. The field emission display of claim 7, wherein the gas-adsorption material comprises a non-evaporable getter.

9. The field emission display of claim 7, wherein the gas-adsorption material comprises a molecular sieve sorbent.

10. The field emission display of claim 1, wherein the phosphor includes particles having a conductive coating.

11. The field emission display of claim 1, wherein the plurality of phosphor vias has a first depth and each phosphor has a second depth less than the first depth of the plurality of phosphor vias.

12. The field emission display of claim 11, further including an optical enhancement film disposed on each of the plurality of via walls of the conductive matrix.

13. The field emission display of claim 1, wherein the conductive matrix defines a surface, and further comprising a gas-adsorption layer affixed to the surface of the conductive matrix.

14. The field emission display of claim 13, wherein the gas-adsorption layer comprises a non-evaporable getter.

15. The field emission display of claim 13, wherein the gas-adsorption layer comprises a molecular sieve sorbent.

16. The field emission display of claim 1, wherein the conductive matrix further defines a gas-adsorption via, and further comprising a gas-adsorption layer disposed within the gas-adsorption via.

17. The field emission display of claim 16, wherein the gas-adsorption layer comprises a non-evaporable getter.

18. The field emission display of claim 16, wherein the gas-adsorption layer comprises a molecular sieve sorbent.

19. The field emission display of claim 1, wherein the conductive matrix includes a contrast enhancement material in an amount sufficient to enhance light absorption by the conductive matrix.

20. The field emission display of claim 1, wherein the contrast enhancement material includes ruthenium oxide.

21. The field emission display of claim 1, wherein the conductive matrix is adapted to receive an anode potential for the field emission display.

22. The field emission display of claim 1, wherein the substrate has a critical temperature, and wherein the conductive matrix comprises a mixture including a gas-adsorption material and an alloy, the alloy having a bonding temperature that is lower than the critical temperature of the substrate, the mixture having a composition of the alloy within a range of 10–80 per cent by volume.

23. The field emission display of claim 1, wherein the conductive matrix includes a contrast layer disposed on the major surface of the substrate.

24. The field emission display of claim 1, further including a spacer affixed to the conductive matrix.

25. The field emission display of claim 24, wherein the spacer has an edge and a bonding layer affixed to the edge, and wherein the bonding layer is affixed to the conductive matrix.

26. The field emission display of claim 1, wherein the phosphor defines a surface, and further including a gas-adsorption layer disposed on the surface of the phosphor.

27. A method for fabricating a field emission display comprising the steps of:

providing a cathode plate having a plurality of electron emitters;

providing a substrate having a major surface;

providing a glass;

admixing a metal to the glass in an amount sufficient to provide a mixture having a metal concentration within a range of 5–100 per cent by volume;

forming a screenable suspension including the mixture;

depositing through a screen the screenable suspension onto the major surface of the substrate to provide a film;

patterning the film to form a plurality of phosphor vias, thereby realizing a conductive matrix;

affixing a phosphor within each of the plurality of phosphor vias, thereby realizing an anode plate; and affixing the cathode plate to the anode plate.

28. The method for fabricating a field emission display as claimed in claim 27, wherein the step of admixing a metal to the glass includes the step of admixing a metal to the glass in an amount sufficient to impart to the conductive matrix a resistivity that is less than 100 $\Omega/cm^2$.

29. The method for fabricating a field emission display as claimed in claim 28, wherein the step of admixing a metal to the glass includes the step of admixing a metal to the glass in an amount sufficient to impart to the conductive matrix a resistivity that is less than 10 $\Omega/cm^2$.

30. The method for fabricating a field emission display as claimed in claim 27, further including the step of admixing a gas-adsorption material to the mixture in an amount sufficient to provide a concentration of the gas-adsorption material within a range of 10–80 per cent by volume.

31. The method for fabricating a field emission display as claimed in claim 27, further including the step of forming a gas-adsorption layer on the conductive matrix.

32. The method for fabricating a field emission display as claimed in claim 27, further including the step of dissolving a photo-sensitive material into the screenable suspension in an amount sufficient to make the film photo-patternable, and wherein the steps of depositing through a screen and patterning the film include the steps of silk-screening the screenable suspension and thereafter photo-patterning the film.

33. The method for fabricating a field emission display as claimed in claim 27, wherein the steps of depositing through a screen and patterning the film include the step of screen-printing the screenable suspension through a screen that defines a pattern for the plurality of phosphor vias.

34. The method for fabricating a field emission display as claimed in claim 27, further including the step of lightly dusting a gas-adsorption material onto the phosphor and the conductive matrix, thereby realizing a gas-adsorption layer.

35. The method for fabricating a field emission display as claimed in claim 34, further including the step of forming a retention layer on the gas-adsorption layer.

* * * * *